US011758330B2

(12) United States Patent
Herger

(10) Patent No.: US 11,758,330 B2
(45) Date of Patent: Sep. 12, 2023

(54) ACOUSTIC INSTALLATION FOR EMISSION OF A TRANSVERSE ACOUSTIC WAVE IN GAS ENVIRONMENT

(71) Applicant: Sotis AG, Altdorf (CH)

(72) Inventor: Danilo Herger, Burglen (CH)

(73) Assignee: Sotis AG

( * ) Notice: Subject to any disclaimer, the term of this patent is extended or adjusted under 35 U.S.C. 154(b) by 83 days.

(21) Appl. No.: 17/421,638

(22) PCT Filed: Nov. 23, 2020

(86) PCT No.: PCT/IB2020/061009
§ 371 (c)(1),
(2) Date: Jul. 8, 2021

(87) PCT Pub. No.: WO2022/034370
PCT Pub. Date: Feb. 17, 2022

(65) Prior Publication Data

US 2022/0345823 A1 Oct. 27, 2022

(30) Foreign Application Priority Data

Aug. 10, 2020 (RU) ..... RU2020126680

(51) Int. Cl.
*H04R 7/04* (2006.01)

(52) U.S. Cl.
CPC ..... *H04R 7/04* (2013.01)

(58) Field of Classification Search
CPC ..... H04R 7/04; H04R 7/045; H04R 7/10
See application file for complete search history.

(56) References Cited

U.S. PATENT DOCUMENTS 6,332,029 B1 * 12/2001 Azima ..... H04R 1/021 381/337
10,231,057 B2 3/2019 Sato et al.
2003/0081800 A1 * 5/2003 Klasco ..... H04R 7/04 381/431

OTHER PUBLICATIONS

Karavashkin et al., "Theoretical Substantiation and Experimental Confirmation of the Existence of a Transversal Acoustic Wave in a Gas," http://selftrans.narod.ru/v2_1/acoustics/acoustics03/acoustics3rus.html, with google translated, prior to Apr. 1, 2012.

* cited by examiner

*Primary Examiner* — Sunita Joshi

(57) ABSTRACT

The device includes a case, a flat membrane, a drive for acoustic vibrations of the transverse acoustic wave. The case is made in the form of a support frame, and a sound-emitting flat rectangular membrane is fixed to the frame. The membrane is made in the form of a honeycomb layer, a surface layer glued to the honeycomb structure from both sides, and a stabilizing impregnating composition covering the surface layers. The acoustic vibrations drive is made in the form of an acoustic vibration exciter, including ferrite parts of the magnetic circuit. The acoustic vibration exciter is attached with one of its ends to the flat membrane within a special line passing along the plane of the rectangular membrane, emerging from any top of the rectangular membrane, and ending at a point on the opposite top of the membrane's horizontal side located at a distance of ⅔ of the membrane's opposite side from the top horizontally.

1 Claim, 5 Drawing Sheets

ACOUSTIC INSTALLATION FOR EMISSION OF A TRANSVERSE ACOUSTIC WAVE IN GAS ENVIRONMENT

CROSS REFERENCE TO RELATED APPLICATIONS

This application is a National Stage Application of PCT/IB2020/061009 filed Nov. 23, 2020, which claims priority from Russian Patent Application No. 2020126680 filed on Aug. 10, 2020. The priority of said PCT and Russian Patent Application are claimed. Each of the prior mentioned applications is hereby incorporated by reference herein in its entirety.

FIELD OF THE INVENTION

The invention is applicable in acoustics. It can be used as a loudspeaker for consumer use where the principle of operation is based on the ability of resonant excitation of bending antiphase vibrations, followed by the emission of transverse acoustic waves into the air (a type of wave process in which shear vibrations of molecules occur perpendicular to the direction of wave propagation).

BACKGROUND OF THE INVENTION

It is known from the article (http://selftrans.narod.ru/v2_1/acoustics/acoustics03/acoustics3rus.html) by S. B. Karavashkin and O. N. Karavashkina (see p. 4) that it is sufficient to use two antiphase emitting acoustic membranes as sources for exciting a transverse wave in gas environment.

Also, a number of devices can be theoretically distinguished from the background of the invention capable of generating transverse acoustic waves. These include a number of well-known musical instruments, such as acoustic guitar, grand piano, drum, violin, etc., Where the resonator body or membrane (in case of a drum) acts as a key element that forms a transverse acoustic wave. The task for design and production of such devices was not to ensure efficient generation of transverse-wave radiation in a wide range of frequencies and with specified parameters of signal characteristics. Thus, their ability to emit sound with a transverse wave component is rather random, and the impossibility of actually adjusting the radiation parameters makes them unsuitable for use in our proposed field of technology.

The closest technical solution can be considered a universal speaker described in the patent of the Russian Federation No. 2692096 dated 21 Jun. 2019. This speaker contains a flat membrane, an excitation unit, a case that forms a cavity in which the membrane and the excitation unit are located. The case has a hole on one surface, and the excitation unit rests with its end against the end edge of the membrane so that it is excited in the same direction as the direction of the membrane plane, and is also rigidly mounted on the case. The membrane forms a cursed part that bends from the side of one end where the excitation unit is installed to the opposite side of the other end and is positioned to cover the opening of the case. The disadvantage of this solution is insufficient work efficiency.

SUMMARY OF THE INVENTION

The tasks that the proposed invention solves:

- increasing the effective operation of the acoustic installation for transverse wave radiation,
- extension of the working frequency range to the limits of audibility of 20-20,000 Hz,
- enabling to control the processes of wave generation in a wide range, compacting the device, in comparison with the analogue, rejecting high-voltage elements (10-30 kV) in the device circuit,
- increasing the efficiency of generating a low-frequency signal with a transverse component of the acoustic wave.

The technical result is an increase in the effective operation of the acoustic installation for transverse wave radiation, expansion of the operating frequency range, increase in the efficiency of generating a low-frequency signal with a transverse component of the acoustic wave.

The technical result is achieved by the fact that the acoustic installation for emission of a transverse acoustic wave in gas environment includes a case, a flat membrane and a drive for acoustic vibrations of the transverse acoustic wave.

The case is made in the form of a support frame, and a sound-emitting flat rectangular membrane is fixed on the frame. The membrane is made in the form of a honeycomb layer, a surface layer glued to the honeycomb layer, a surface layer glued to the honeycomb structure from both sides, and a stabilizing impregnating composition based on polyurethane primers and varnishes covering the surface layers The drive for acoustic vibrations is made in the form of at least one exciter of acoustic vibrations, including ferrite parts of the magnetic circuit, and at least one exciter of acoustic vibrations is attached at one end to a flat membrane within a special line passing along the plane of the rectangular membrane, emerging from any top of the rectangular membrane, and ending at a point on the opposite top of the membrane's horizontal side located at a distance of ⅔ of the membrane's opposite side from the top horizontally.

The proposed invention makes it possible to design and implement a compact effective device in areas where it is required to create transverse-wave acoustic radiation in the gas environment, not only for the purpose of studying the properties of such radiation but also for its practical use, for example, in the form of a loudspeaker with improved sound quality.

DETAILED DESCRIPTION

Figure 1:
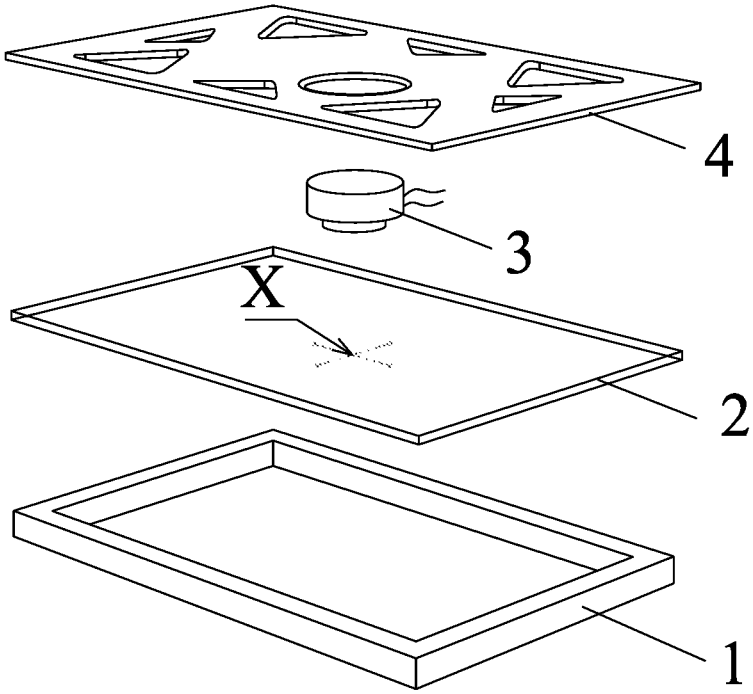
FIG. 1—a general diagram of a device emitting a transverse acoustic wave in a gas environment, indicating all the main elements, FIG. 2—a rear view of a device emitting a transverse acoustic wave in a gas environment, FIG. 3-*a* schematic representation of the conditions for the occurrence of a transverse acoustic wave in gas environment, FIG. 4—external view of the device emitting a transverse acoustic wave, FIG. 5—the position of a special (orange) line within the plane of the sound-emitting membrane where it is recommended to place at least one or several acoustic vibration exciters.
Figure 2:
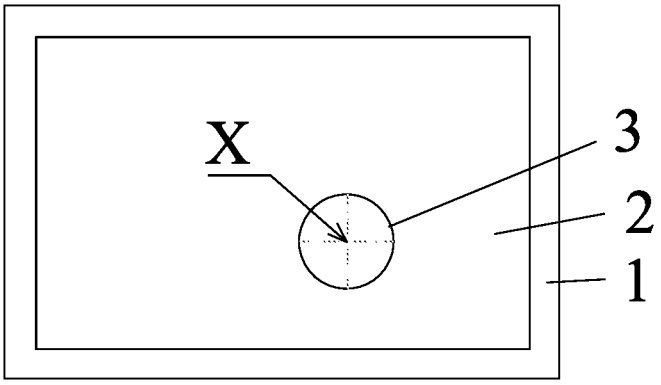

The device we propose for the emission of a transverse acoustic wave is shown in FIGS. 1 and 2, and includes: a support frame (1), a sound-emitting membrane (2), an acoustic vibration drive (3), including parts of a ferrite magnetic circuit, as well as a coil of different types proposed: flat, square (rectangular), wavy flat, cylindrical (round), star-shaped, and a rear support cover for the drive (4).

For example, the acoustic vibration drive (3) includes one (or more) acoustic vibration exciters containing a case in which the following components are installed: a magnetic system, a cylindrical coil fixed to the frame, a system holding the coil within a magnetic gap, and flexible wires for supplying an electrical signal to the coil. The magnetic system is made as a cylindrical permanent magnet, a ferrite ring with the above mentioned cylindrical magnet and washers, joining them into a single structure. The cylindrical coil fixed to the frame is located above the cylindrical magnet and in the gap between the cylindrical magnet and the ferrite ring. The system holding the coil within the magnetic gap consists of two centering washers of different diameters fixed at some distance from each other, in the form of concentrically corrugated disks, the inner hole, attached to the cylindrical coil, attached to the frame, and the outer perimeter—to the enclosure and flexible wires supplying an electrical signal to the coil are sewn into one of the centering washers and are soldered at one end to the coil terminals, and the other one—to the outer contact group. The cylindrical coil frame is attached to the sound emitting membrane (2).

The sound-emitting membrane (2) is made of a light and rigid material. It is a sandwich structure including a honeycomb layer, a surface layer glued to the honeycomb structure from both sides and a stabilizing impregnating composition based on polyurethane primers and varnishes covering the surface layers.

Such a membrane (2) begins to transmit traveling wave structures on the surface formed by an acoustic vibration drive (3) attached to the membrane surface. The waves traveling on the surface that have a finite propagation velocity in the membrane material repeatedly re-reflecting from the edges of the membrane itself form resonant-conditioned, frequency-dependent modulations, zonally localized over the area of the panel. These modulations have one distinctive feature: they arise in the form of strictly opposite balanced oscillations within one indivisible sound-emitting membrane (2).

Figure 3:
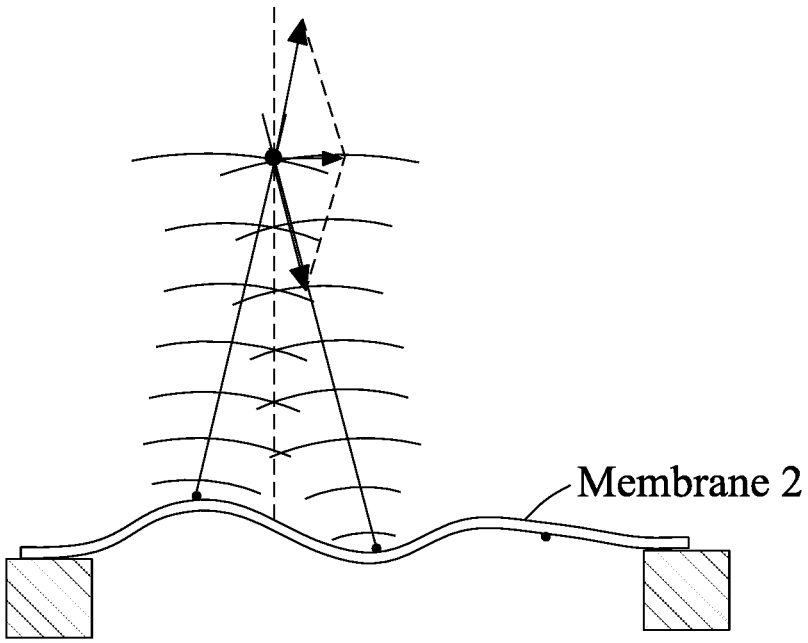

For ease of understanding, these opposite bending vibrations can be represented as a set of incoherent point acoustic emitters (speakers) strictly out of phase at 180 degrees, see FIG. 3. This operation mode of the proposed acoustic emitter is basic and necessary, since the process of effective sound signal generation stops in modes that go beyond the resonant balanced formation of opposed modulations, and the conditions necessary for the wave transverse component formation do not arise.

Figure 5:
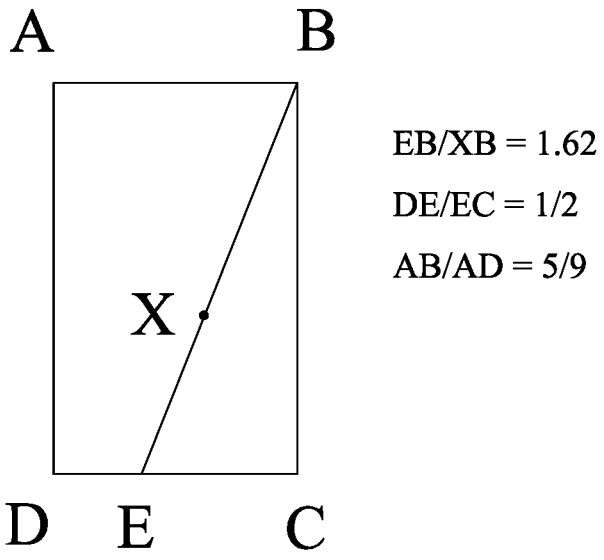

Also, numerous practical experiments have resulted in establishment of a special EB line (see FIG. 5) passing along the plane of the sound-emitting membrane, within which the acoustic vibrations exciter or several of them should be installed so that the point of the exciter's rotation axis includes a special line, or crosses the front projection of the exciter circuit installed near the special line. So if we take into consideration a sound-emitting membrane whose angles represent points A, B, C and D (see FIG. 5), a special "orange" line of exciters attachment will pass from point B to point E. In turn, E is a point on the DC side of the membrane in which it will divide the DC segment in the following proportion: DE\EC=½. Within the EB line, one or more vibration exciters can be installed. For a technical solution with one acoustic vibrations exciter within such a line, it is necessary to determine the X point according to the following proportion: EB\XB=1.62. Naturally, the orange line EB can be symmetrically reflected along any axis of symmetry of the membrane.

The advantage of the proposed technical solution in the form of a special line within the membrane area, assuming the attachment of excitation sources within it, ensures the optimal distribution of resonant modulations within the membrane area, which in turn has a positive effect on the uniformity of the amplitude-frequency response, and also ensures sound naturalness, closely related to the total amount of distortions caused by the speaker system's operation, reduction of phase shifts, and ensures the maximum frequency range in the operation of such a system.

In our acoustic device, no special measures are required to maintain the condition for the existence of a transverse sound wave. The very resonant mode of such a device operation assumes the constant presence of suitable conditions for the generation and maintenance of the transverse wave. Moreover, these conditions exist as a continuous readiness of transverse wave radiation in gas at practically any frequency of the acoustic range, including wider limits in the area of low and high frequencies, if necessary. So, to implement radiation with a transverse component, it is enough to bring one single excitation source to the emitter powered by a single-channel power amplifier and apply the appropriate signal (for example, sinusoidal, of a certain frequency, or broadband ("pink noise", music content, etc.))

Figure 4:
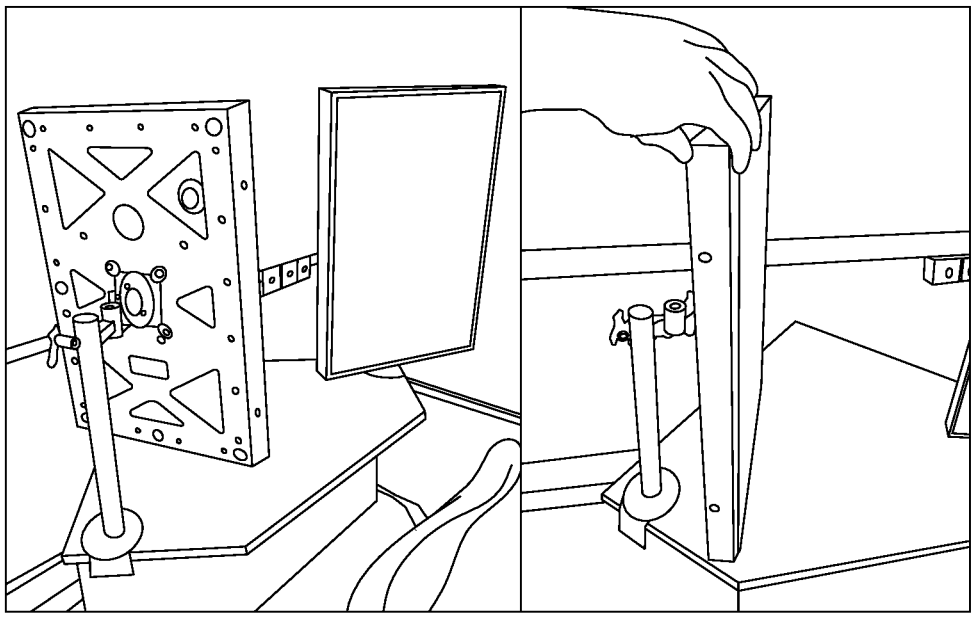

The external view of the proposed acoustic installation for radiation of a transverse sound wave in a gaseous environment is shown in FIG. 4.

At the same time, it is important to emphasize the fundamental impossibility of high-quality generation of a transverse acoustic wave at the Karavashkin installation while simultaneously transmitting signals of different frequencies and amplitudes to it. This is due to the fact that the formation of all frequencies by one piston emitter causes the acoustic Doppler effect. This unambiguously leads to the impossibility of maintaining phase consistency in the entire range of simultaneously applied frequencies.

In case of our construction (the membrane is made of honeycomb material and a certain location on the acoustic vibration exciter membrane), when the frequency modulations are zoned over the area of the panel, the lower frequency is not the main for the higher ones and the Doppler effect does not occur. Thus, only such a solution makes it possible to continuously generate and maintain a transverse acoustic wave in the gas in the entire spectrum of simultaneously applied frequencies and obtain the claimed technical result.

The invention claimed is:

1. A device for emission of a transverse acoustic wave in a gas environment comprising:

a case in the form of a support frame, a flat rectangular membrane fixed to the support frame, said rectangular membrane having four corners and four sides, a drive for acoustic vibrations of the transverse acoustic wave comprising at least one acoustic vibration exciter having a magnetic circuit including ferrite parts, wherein the membrane comprises first and second surface layers glued to respective first and second sides of a honeycomb layer, and a stabilizing impregnating composition based on polyurethane primers and varnishes covering the surface layers, wherein the at least one acoustic vibration exciter has a moveable end attached to the flat membrane within a special line passing along a plane of the rectangular membrane, emerging from a first one of the corners of the rectangular membrane, and ending at a point on the membrane side opposite to the first one of the corners located at a distance of ⅔ between the corner opposite to the first one of the corners, and another one of the corners.

* * * * *